United States Patent [19]

Steddom et al.

[11] 4,041,439

[45] Aug. 9, 1977

[54] POTENTIOMETERS

[75] Inventors: Clark M. Steddom, Santa Barbara; Charles W. Yungblut, Irvine, both of Calif.

[73] Assignee: Carrier Corporation, Syracuse, N.Y.

[21] Appl. No.: 606,262

[22] Filed: Aug. 20, 1975

[51] Int. Cl.[2] ..... H01C 10/00

[52] U.S. Cl. ..... 338/78; 29/621; 338/322; 338/324; 339/17 R

[58] Field of Search ..... 338/68, 78, 322, 324, 338/334; 29/610, 620, 621; 427/101; 339/17 R, 32 R, 32 M

[56] References Cited

U.S. PATENT DOCUMENTS

| | | | |
|---|---|---|---|
| 3,772,630 | 11/1973 | Falco | 338/162 X |
| 3,846,731 | 11/1974 | Dumas et al. | 338/162 X |

*Primary Examiner*—C. L. Albritton

*Attorney, Agent, or Firm*—J. Raymond Curtin; Barry E. Deutsch

[57] ABSTRACT

A potentiometer including a resistance track and a wiper element adapted for relative movement with respect thereto includes first, second and third terminals connected respectively to each end of the resistance track and to the wiper element. The potentiometer further includes conductive means to effectively reverse the electrical positions of the terminals connected to either end of the resistance track.

4 Claims, 3 Drawing Figures

POTENTIOMETERS

BACKGROUND OF THE INVENTION

This invention relates to potentiometers, and in particular, to a novel manner of effectively reversing the electrical positions of terminals connected to either end of a potentiometer's resistance track.

Potentiometers of the type well known to those skilled in the art are employed in many varied applications. Such potentiometers include a resistance track having first and second terminals connected respectively to each end thereof. A wiper element is adapted for relative movement with respect to the resistance track. The wiper element is also connected to a terminal.

In some applications, both resistance track end terminals are connected to an electrical circuit whereby relative movement between the wiper element and resistance track varies the resistance between the wiper terminal and each of the resistance track end terminals. In other applications, the potentiometer is employed in the electrical circuit as a rheostat. When used as a rheostat, only a selected one of the resistance track end terminals, and the wiper terminal, are connected in the electrical circuit. When used as a rheostat, the potentiometer does not provide any resistance at a first position of the wiper element with respect to the resistance track. As a relative movement between the wiper element and resistance track occurs, the resistance of the potentiometer increases, until the potentiometer's maximum resistance is established. The wiper element has been thus moved to a second position with respect to the resistance track.

Very often, the electrical circuit in which such devices are employed requires that the resistance increase between the wiper terminal and a preselected one end terminal upon a clockwise relative movement between the wiper element and resistance track, and decrease upon a counterclockwise relative movement therebetween.

Heretofore, potentiometers have been constructed whereby maximum resistance between the wiper element terminal and a selected one of the resistance track end terminals might only be readily obtained with rotation in a preselected direction, for example, clockwise rotation. Thus, potentiometers affording maximum resistance between the wiper terminal and selected one end terminal when relative movement between the wiper element and resistance track is in a conterclockwise direction cannot be interchangeably employed with potentiometers affording maximum resistance when relative movement occurs in the clockwise direction. In many prewired applications, manuals or other literature indicate which of the two types of potentiometers are employed. Persons adjusting such potentiometers, look to the manuals for guidance in order to properly vary the resistance of the potentiometer to obtain a desired value. The utilization of potentiometers having increasing resistance when relative movement occurs in a clockwise direction, where manuals indicate that resistance increases upon relative movement in a counterclockwise direction can cause intolerable problems.

It might be thought that utilizing the other end terminal could permit a potentiometer, having a resistance increase upon clockwise movement, to be employed in applications normally using potentiometers having their resistance increase upon relative movement in the counterclockwise direction.

However, in applications involving the production of prewired circuits on a mass production basis, the two types of potentiometers cannot be readily interchanged without introducing problems and requiring expensive modifications in the assembly process.

In order to provide potentiometers suitable for use in applications requiring maximum resistance on relative movement in both clockwise or counterclockwise directions, configuration changes in the size and/or shape of one or more of the component parts has heretofore been required. For example, a "mirror image" of the complete potentiometer could be provided. Alternatively, the shape and location of te resistance track end terminals could be suitably modified. However, such changes would be expensive, involving extensive modifications to fabricating and assembly tooling and fixtures.

SUMMARY OF THE INVENTION

It is accordingly, an object of this invention to electrically reverse the positions of resistance end terminals without changing performance characteristics of a potentiometer.

It is a further object of the invention to electrically reverse the position of resistance end terminals without requiring configuration changes of any of the component parts of the potentiometer.

It is a further object of this invention to accomplish such changes without requiring extensive changes in the assembly procedure.

It is another object of this invention to electrically reverse positions of resistance end terminals without requiring extensive changes to fabricating and assembly tooling and fixtures.

These and other objects of the instant invention are attained in a potentiometer having a resistance track, and a wiper element adapted for relative movement therebetween whereby the resistance of the potentiometer may be suitably changed. A first terminal is connected to one end of the resistance track and a second terminal is connected to the other end of the resistance track. The wiper element is electrically connected to a third terminal. The potentiometer further includes means to electrically reverse the positions of the first and second terminals with respect to the ends of the resistance track, with the first terminal being electrically connected to the other end of the resistance track and the second terminal being electrically connected to the first end of the resistance track.

DESCRIPTION OF THE PREFERRED EMBODIMENT

Figure 1:
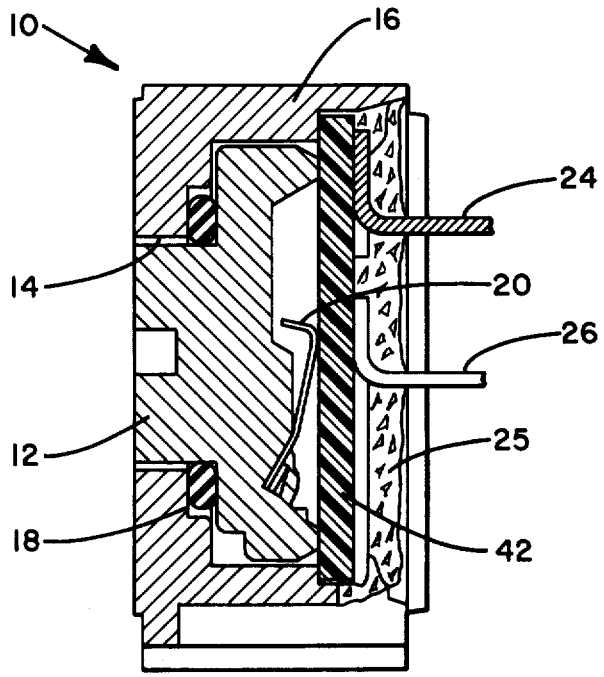
FIG. 1 is a sectional view of a potentiometer in which the instant invention may be satisfactorily employed.

Referring now to the drawings and in particular to FIG. 1, there is disclosed a sectional view of a potentiometer exemplifying the type in which the instant invention may be satisfactorily employed.

Potentiometer 10 includes housing 16, having a rotor assembly 12 rotatably received within a bore 14 of the housing. An O-ring 18 or other suitable means is employed to prevent foreign matter from entering through the space provided between rotor assembly 12 and housing 16. The rotor assembly includes a wiper element or contact member 20 mounted thereon. As is known to those skilled in the art, the wiper element is movable relative to the resistance element of the potentiometer to vary the resistance thereof as is desired.

Preferably, a non-conductive substrate 42 is provided in housing 16. The substrate may be shaped in the form of a circular, rectangular, or square disk or wafer. In the preferred embodiment, the substrate is shown as a substantially square disk. Other geometric configurations may be suitably employed. Preferably, epoxy 25, or other suitable material, is provided to permanently seal the various components of the resistance device within the housing assembly. The epoxy provides a permanent seal to prevent foreign manner from gaining entrance into the interior of the resistance device. Terminal posts, such as posts 24 and 26, extend through epoxy 25. The posts are provided to connect the potentiometer in an electrical circuit.

Figure 2:
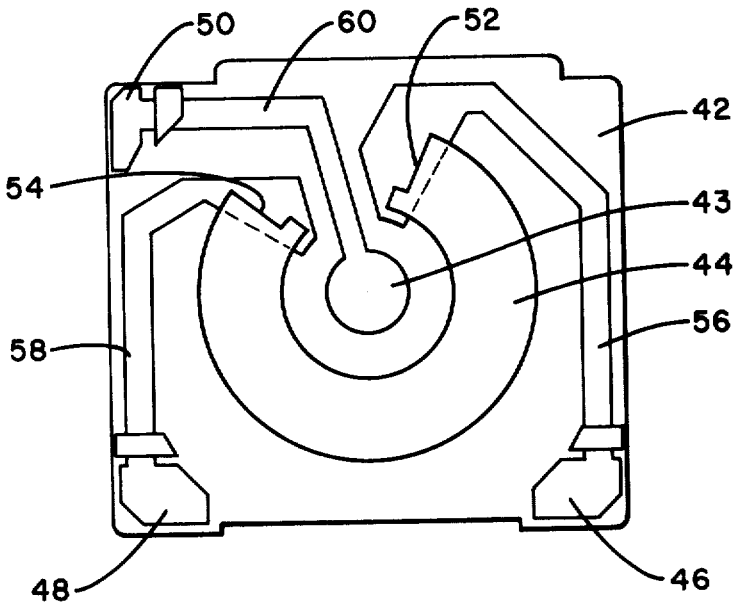
FIG. 2 PRIOR ART
FIG. 2 is a plan view of a portion of a potentiometer having a resistance track and terminals in accordance with the prior art.

Referring now to FIG. 2, there is disclosed a substrate element typifying those of the prior art. Element 42 has a resistance track 44 formed on a first surface thereof. Track 44 is generally annular in shape. The resistance material defining the resistance track may comprise either a cermet composition or a carbon composition, both types of resistance material being well known to those skilled in the art. The resistance material may either be sprayed, screened, brushed or stenciled onto the surface of the substrate. Substrate 42 additionally has material defining a conductive path deposited by suitable means, for example either by spraying or screening on the first surface thereof. The conductive path includes a collector portion 43, and terminal end portions 46, 48 and 50. Terminal end portion 50 is connected to collector portion 43 via conductor 60. The conductive material used to form the various sections of the conductive path may comprise a silver or gold composition. The configuration of the conductive path may be suitably modified to meet the requirements of particular applications.

As is known to those skilled in the art, the wiper element is designed to move relative to resistance track 44 whereby the resistance of the potentiometer may be varied. Potentiometers of the type described may be connected in an electrical circuit whereby only the collector terminal and a selected one of the resistance end terminals are utilized. Where so connected, the potentiometer functions as a rheostat. When the potentiometer is employed as a rheostat, the potentiometer will have a maximum resistance value when the wiper element is at one end of the resistance track and essentially have zero resistance when the wiper element is at the othe end of the resistance track.

In the embodiment illustrated in FIG. 2, the resistance of the potentiometer will be at its maximum value when the wiper element is positioned substantially adjacent end 52 of resistance track 44 and terminal portion 48 is the selected one terminal connected in the electrical circuit. Rotation of the wiper element in a clockwise direction will decrease the value of the potentiometer's resistance until, when the wiper element is positioned adjacent end 54 of resistance track 44, the resistance of potentiometer 10 is established between terminal portions 48 and 50 is substantially null. Potentiometers including substrate 42 could not be satisfactorily employed in circuits requiring that the potentiometer have increasing resistance upon clockwise rotation of the wiper element.

Figure 3:
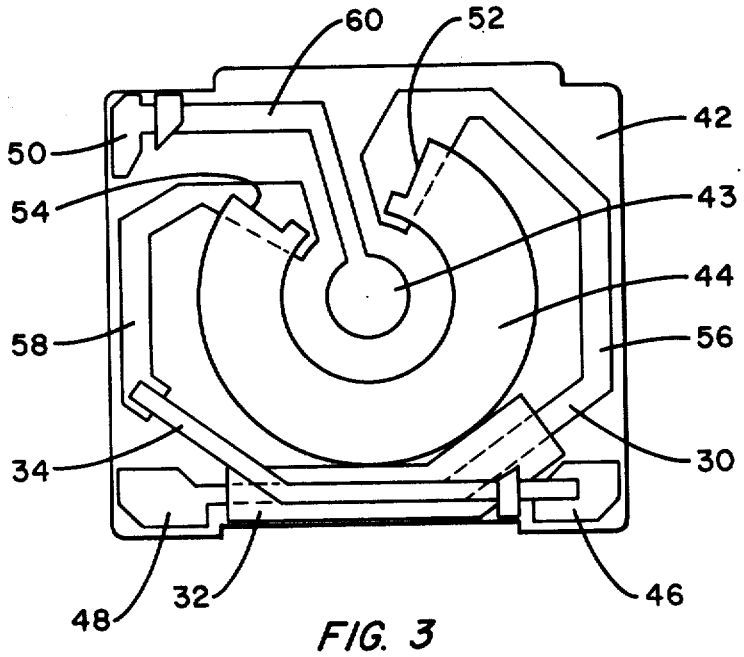
FIG. 3 is a view similar to FIG. 1 illustrating the present invention.

With particular reference now to FIG. 3, there is shown a modified substrate 42 including the instant invention. Substrate 42, as modified by the instant invention, permits potentiometers employing same to be utilized in applications requiring an increase in resistance upon clockwise wiper rotation, with terminal portion 48 connected in the circuit. This result is obtained without materially increasing the cost of manufacturing the potentiometer and is also obtained without sacrificing any performance quality. With reference to FIG. 2, it will be observed that conductor 56 has heretofore connected resistance end 52 to terminal end portion 46. With reference to FIG. 3, it will be observed that conductive portion 56 does not terminate at terminal 46, but rather is connected, via a second conductive portion 30, to terminal portion 48. Similarly, resistance end 54, which had previously been connected to terminal 48 via conductor 58 (see FIG. 2) is now connected to terminal 46 via conductor 58 and conductor 34. Conductor 34 crosses over conductor 30, but is electrically insulated therefrom by a suitable dielectric material 32, for example a glass compound. In effect, by utilizing electrically conductive crossovers 30 and 34, the position of terminals 46 and 48 are electrically reversed. Consequently, terminal 48 is connected to resistance end 52 and terminal 46 is connected to resistance end 54. Thus, when the wiper element is rotated in a clockwise manner from a position starting adjacent end portion 52, the resistance of the potentiometer between terminals 48 and 50, is increased until its maximum value is obtained when the wiper element is adjacent end 54. When the wiper element is adjacent end portion 52, the resistance of the potentiometer is essentially null.

By utilizing electrical crossovers 30 and 34 and having them electrically insulated by dielectric 32, the electrical positions of terminals 46 and 48 can be effectively reversed. To achieve the foregoing, only inexpensive screens or masks, for applying the appropriate patterns during screening operations are initially required. The cost is minimal since only additional small quantities of conductive material and dielectric material are required. The instant invention permits the electrical reversal of terminal positions without requiring changes in size, shape or configuration of any of the parts.

"Conductive crossovers" have heretofore been employed in fixed resistors of the type having a multiple number of fixed resistors on a single backing wherein the conductive leads from the resistors have been led across one another with dielectric material insulating the respective leads at their points of contact. However, the utilization of the conductive crossovers in the manner disclosed herein achieves a completely different function and provides a novel variable resistor or potentiometer.

While a preferred embodiment of the instant invention has been described and illustrated, the invention should not be limited thereto, but may be otherwise embodied within the scope of the following claims.

We claim:

1. In a potentiometer having a resistance track, a wiper element adapted for relative movement therebetween, and first, second and third terminals connected by first electrical conductors respectively to each end of said resistance track and to said wiper element, movement of said wiper element relative to said resistance track in a first direction increasing the resistance between the third terminal and a selected one of the terminals connected to an end of the resistance track, and relative movement of said wiper element in a second direction decreasing the resistance therebetween, the improvement comprising:

second electrical conductors connected to said first and second terminals, with said first and second terminals being disconnected from said first conductors, to reverse the electrical position of said terminals at the ends of said resistance track whereby relative movement of said wiper element in said first direction will decrease the resistance between the third terminal and said selected one end terminal, and relative movement of said wiper in said second direction will increase the resistance therebetween.

2. In a potentiometer having a movable wiper element for varying the resistance of the potentiometer, the improvement comprising:

a non-conductive substrate having a resistance track formed on a first surface thereof, a first terminal being electrically connected to a first end of the resistance track, a second terminal being electrically connected to the other end of the resistance track, and a third terminal connected to the wiper element; and a first electrically conductive track to electrically connect said first terminal to the other end of said resistance track and a second electrically conductive track to electrically connect the second terminal to said first end of said resistance track, said first and second terminals being respectively disconnected from said first and second ends of said resistance track.

3. A potentiometer in accordance with claim 2 wherein said first and second electrically conductive tracks are electrically insulated from each other and comprise first and second electrical conductors superimposed one upon the other.

4. A method of manufacturing a potentiometer comprising the steps of:

forming a resistance track on a non-conductive substrate, with a first terminal being normally connected to a first end of the resistance track, and a second terminal being normally connected to the other end of the track, with a wiper element provided to move relative to the resistance track being connected to a third terminal;

forming a first electrically conductive track to interconnect the first terminal with the other end of the resistance track, the first terminal being disconnected from the first end of the resistance track; and forming a second electrically conductive track, electrically insulated from said first conductive track, to interconnect the second terminal with the first end of the resistance track, the second terminal being disconnected from the other end of the resistance track, whereby the electrical positions of said first and second terminals are reversed.

* * * * *